US005285704A

United States Patent [19]

Santana Gonzalez

[11] Patent Number: 5,285,704

[45] Date of Patent: Feb. 15, 1994

[54] CASTER ANGLE REGULATING TOOL

[76] Inventor: Pedro Santana Gonzalez, Rodriguez Pena 2128, Castelar, Argentina, 1712

[21] Appl. No.: 888,643

[22] Filed: May 27, 1992

[30] Foreign Application Priority Data

Jun. 11, 1991 [AR] Argentina ..... 319.907

[51] Int. Cl.[5] ..... B25B 11/00

[52] U.S. Cl. ..... 81/484; 29/271

[58] Field of Search ..... 81/484, 488; 29/271

[56] References Cited

U.S. PATENT DOCUMENTS 1,554,468 9/1925 Tague ..... 81/484

5,083,621 1/1992 Sheridan ..... 81/57.46

OTHER PUBLICATIONS

Abstract of Argentine Pat. No. 221,305 w/English translation.

Abstract of Argentine Pat. No. 222,603 w/English translation.

Abstract of Argentine Pat. No. 221,604 w/English translation.

*Primary Examiner*—James G. Smith

*Attorney, Agent, or Firm*—Jacobson, Price, Holman & Stern

[57] ABSTRACT

A caster angle regulating tool for automobile wheels includes a prismatic head (15), a set of wheel drum plate mounting disks (18, 19, 20) interchangeably attachable by screws (25) in holes (23) therethrough to screw threaded bores (17) in bosses (16) on the prismatic head (15), a pivotable adjusting nut (11) pivotly mounted by opposite axle shafts (12) thereon in bearings (13) in brackets (14) mounted on the prismatic head, a screw threaded adjusting shaft (6) engageable in the adjusting nut (11) and a clamping device (1, 2, 3, 4) rotatably mounted on one end (5) of the adjusting screw for clamping onto a stub axle (M) attached to the wheel drum plate (R). Rotation of the adjusting shaft (6) in the adjusting nut (11) thereby moves the spring stub axle to increase or decrease the caster angle, depending upon the direction of rotation of the adjusting shaft during alignment of the wheels. Each of the mounting disks of the set of mounting disks has a plurality of radial slots (21, 27, 29) extending radially outwardly from a central hole and a plurality of second slots (22, 26, 28) equally angularly spaced with respect to each other and varying in number to facilitate use of the set of disks on wheels having varying numbers and sizes of wheel drum attaching screws thereon.

5 Claims, 3 Drawing Sheets

1
2
3
4
5
6
7
8
9
11
12
13
14
15
16
17
18
19
21
22
23
24
25
26
27
S
M
R
T

CASTER ANGLE REGULATING TOOL

BACKGROUND OF THE INVENTION

The instant invention relates to a wheel aligning tool or device for regulating the caster angle of automobile forward or rear wheels, by correcting their relationship with the chassis or sub-frame.

The natural de-regulation of the caster angle, whether positive or negative, is due to the excessive stress imparted to the forward wheels of the vehicle, whether of forward or rear traction. This condition, added to the natural metal fatigue and the poor condition of roads, makes it imperative to correct or regulate the caster angle in order to obtain a proper alignment of the vehicle wheels.

Steering features of an automobile depend on its reversibility, progression and stability conditions, which are basic for attaining comfort and safety of the driver, by providing accurate and easy driving of the vehicle.

The pivot around which the wheel rotates is not a vertical pivot, but it is forwardly directed a certain angle called a caster angle. A "wanderer" steering, an abrupt steering or a hard and dangerous steering depend on the caster angle, as well as the deviation from the road. Its wrong adjustment may also cause shimmying.

This pivot should also have a king pin inclination or outward slant measured angularly with respect to the vertical plane.

On the other hand, the stub axles should form a downward angle, called drop or camber.

Further, the front wheels are toed-in which compensates the trend of the wheels to open during running.

Shaft alignment after checking the four steering parameters, advance, outward slant, camber and convergence, is highly important since driving safety and ease, as well as life of tires will depend on their accuracy, according to manufacturing standards.

The vehicle running gear has manual means allowing controlling and correcting these parameters by an operator except angular variations which may have been produced between the fixing plate plane of the wheels and the suspension stub axles, since this is a rigid assembly, whose caster angle is factory preset.

These angular variations related to the caster angle of the wheels may be produced at the front gear as well as at the rear gear of the vehicle, with respect to the chassis or sub-frame thereof.

A caster angle regulating tool should resist the stress to which it is subjected for counterbalancing the forward part strength. This is the reason for this regulating tool. Further, such tool should be easily handled by the operator.

Basically, there are three types of tools for correcting the caster angle which differ from each other, but all of them use the coupling of the torsion lever to the wheel plate, and the support arm on the sleeve of the suspension spring, this pertaining to prior art in the public domain.

One of the known types according to Argentine Patent No. 222,604, uses a means for coupling the torsion lever to the wheel plate and a support arm at the suspension spring stub axle, assisted by two or three coupling disks for the vehicle wheel which are mounted by means of three, four or five screws to the brake drum. These disks are interchangeable for being adapted to different automobile models.

A second type of tool shown in Argentine Patent No. 222,603 uses a universal turnbuckle with lefthand screw thread and nut on one side and righthand screw thread on the opposite side, mating with a coupling disk having a plurality of holes provided to be adapted to the vehicle model involved.

A third type of tool shown in Argentine Patent No. 221,305 uses a Whitworth thread screw and nut. The position of the nut should be changed before or after the lever, depending on whether the caster angle is to be increased or decreased. This tool uses six or seven coupling disks for coupling to the wheel plate, according to the vehicle model. In an alternative embodiment, one end of the lever is provided with a pivoting bushing, allowing a better operation of the tool. The lever has a single disk with multiple holes for fixing it to different kinds of wheels.

All these arrangements have several disadvantages, one of the main disadvantages being the high force required for their operation and the short life of the mechanism, in spite of its lubrication.

BRIEF SUMMARY OF THE INVENTION

The instant invention provides a tool for regulating the caster angle of automobile wheels for correction of the front gear or rear gear related to the chassis or sub-frame, increasing or decreasing the caster angle until the correct angle is obtained, according to the direction in which the tool is rotated as required, thus avoiding the early change of the whole part and obtaining a proper alignment of the vehicle wheels. The tool for correcting the caster angle of the instant invention uses the same principle of the general technique, i.e, the arm support by means of clamps at the suspension spring sleeve and disk coupling in the wheel plate. At the angle, or at the apex, formed by the arm and the lever (lever head), the tool has a force thread nut, or preferably a square thread.

The caster angle regulating tool should resist the stress to which it is subjected in order to counteract the mechanical resistance of the part forming the running gear. The tool should be easily operated. The tool of the invention is of the type provided with a support for the lever arm, by means of clamps fixed to the stub axle and passes through a pivoting nut, which allows its being actuated from the opposite end, rightwards or leftwards, as desired, or to decrease the caster angle without any change in the position of the parts forming the tool. The pivoting action of the nut around its rotation axis changes the force vector from straight to circular, thus causing the lever to move the stub axle altering the caster angle. (In the prior art, the nut must be actuated.)

Another feature of the tool of the invention is the shape of the coupling interchangeable disks, which in this case are only three, corresponding to wheels supported by three, four or five bolts. Holes are replaced by stepped slots or grooves, with a view to obtaining broad adaptability to serve for wheel plates of all vehicle models.

The grooves or slots are stepped in order not to weaken the disk, since the position of the wheel screws is always symmetrical, and they may receive wheels from the smaller to the larger diameters.

In accordance with the principles of the invention, the tool for regulating automobile wheel caster angle comprises a lever for fixing it to the suspension spring stub axle, which may be coupled to the plate of the corresponding wheel by a worm screw shaft forming a lever, the nut of which is provided with a pair of axle shafts linked to said head, while one end of the worm provides a clamp for clamping to the stub axle and the opposite end is provided with the worm screw shaft driving means.

BRIEF DESCRIPTION OF THE DRAWINGS

The invention will now be described in detail with reference to the accompanying drawings wherein.

DETAILED DESCRIPTION OF THE PREFERRED EMBODIMENT

Figure 4:
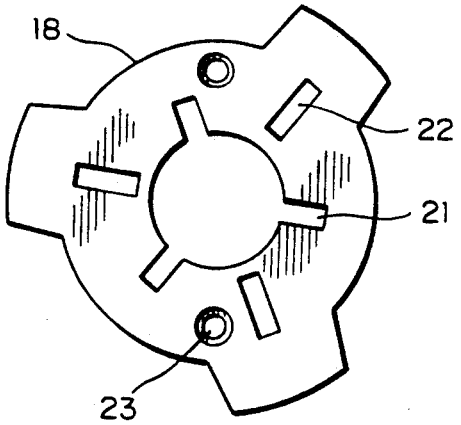
FIG. 4 is a plan view of a disk for fixing wheels mounted with three screws.
Figure 5:
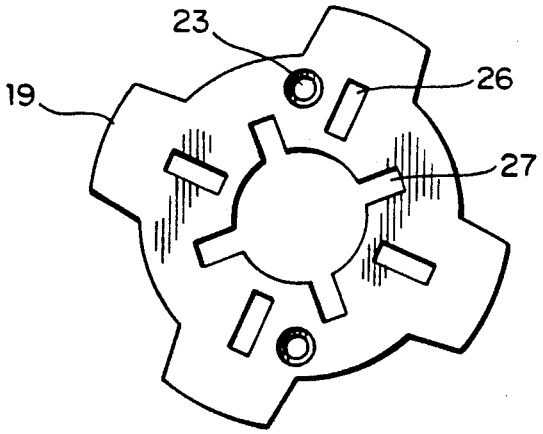
FIG. 5 is a plan view of another disk for mounting wheels supported by four screws.
Figure 6:
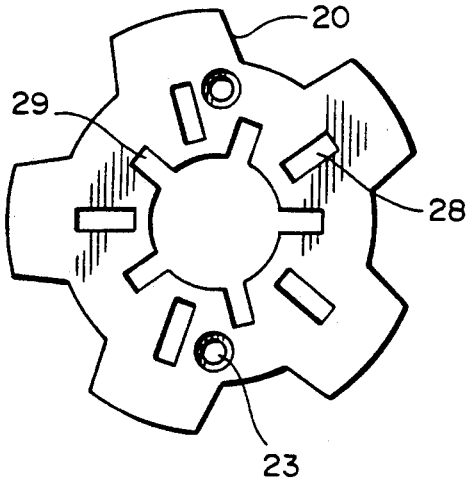
FIG. 6 is a plan view of a third disk for coupling wheels by means of five screws.

In FIGS. 4, 5, and 6, the three disks are represented, wherein 18 designates the three groove disk, 19 the four groove disk and 20 the five groove disk.

Figure 1:
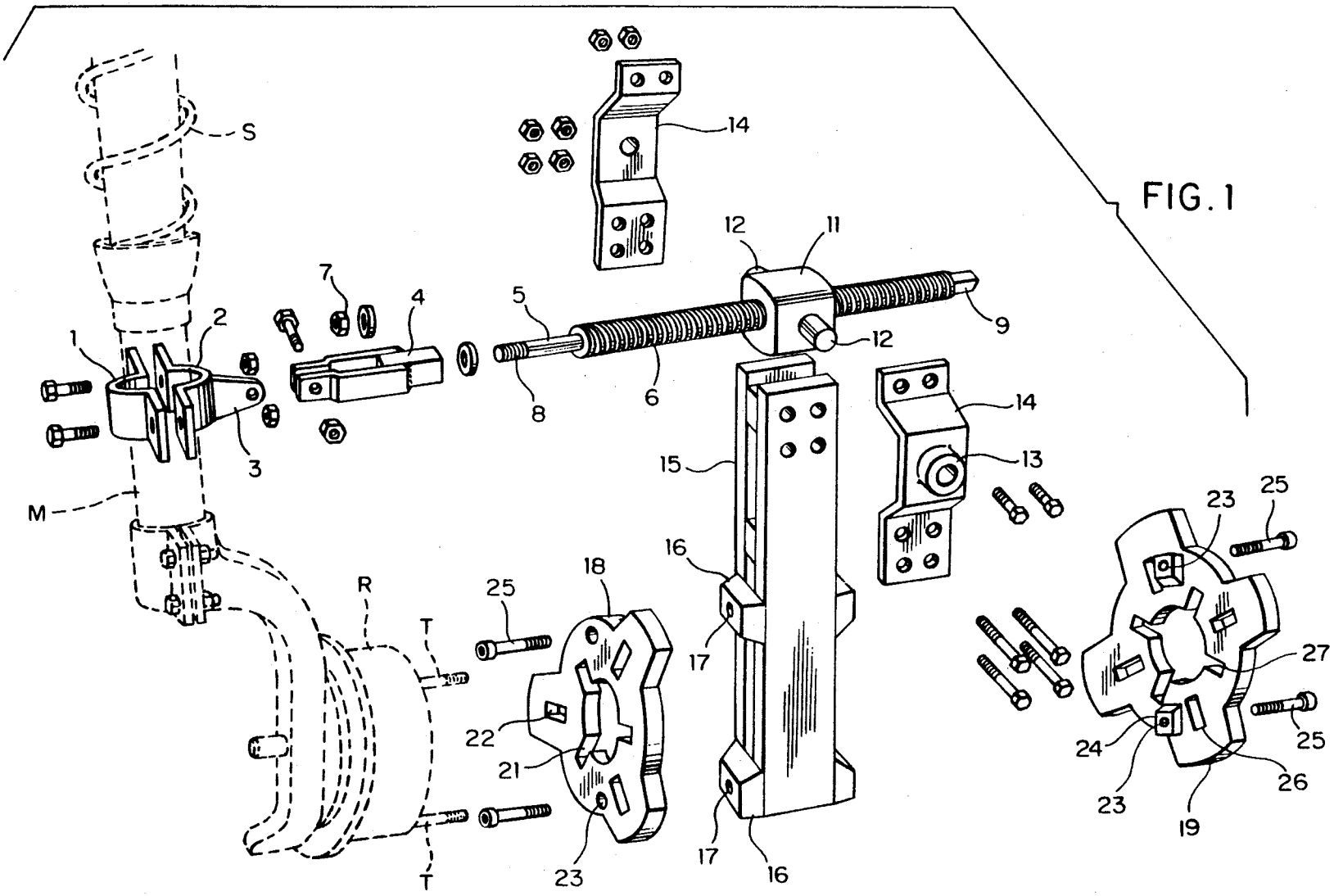
FIG. 1 is an exploded perspective view of the tool of the invention showing its essential forming elements.
Figure 2:
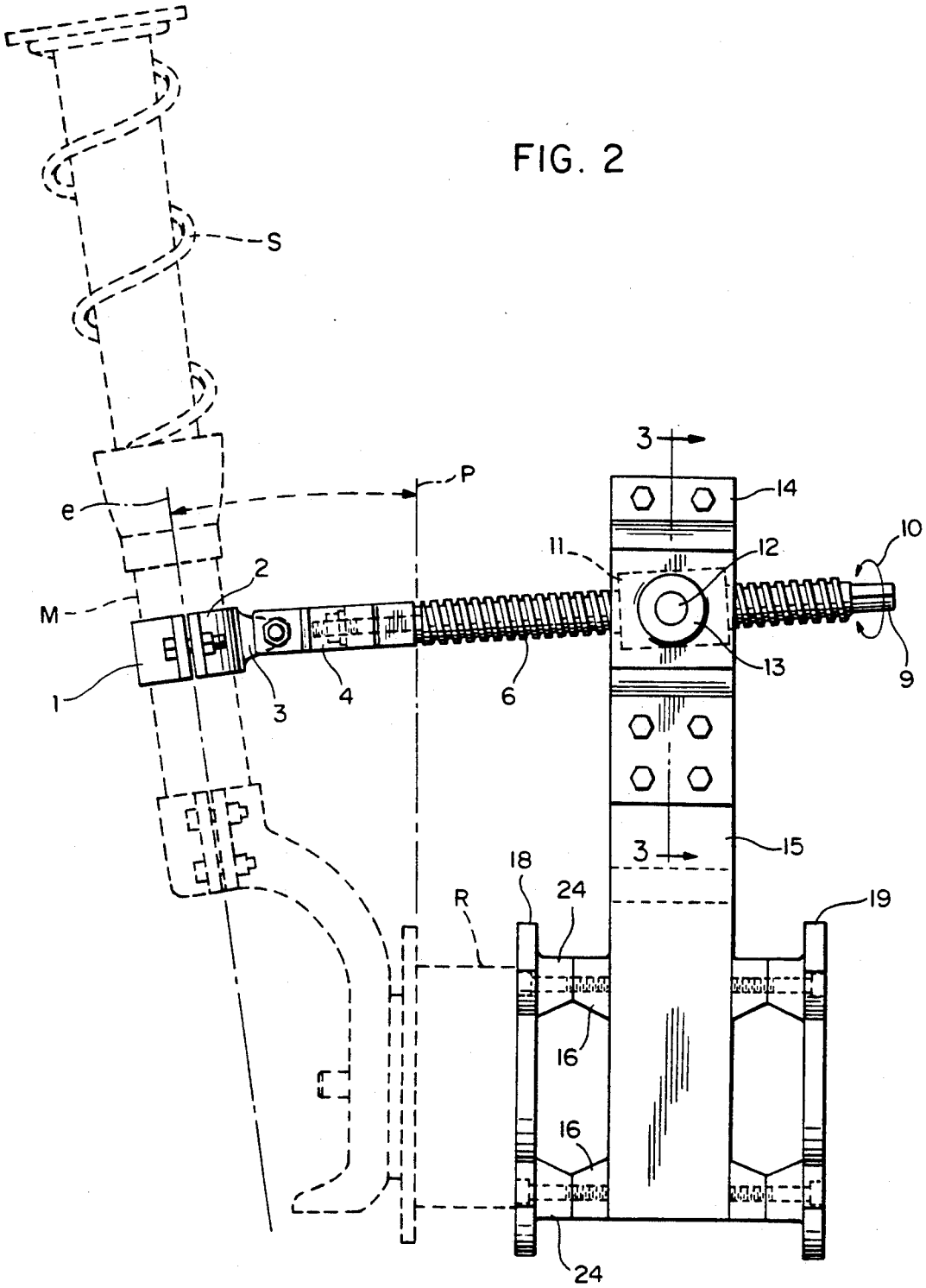
FIG. 2 is a side elevational view of the tool placed between the suspension spring stub axle and the plate fixing the corresponding wheel.
Figure 3:
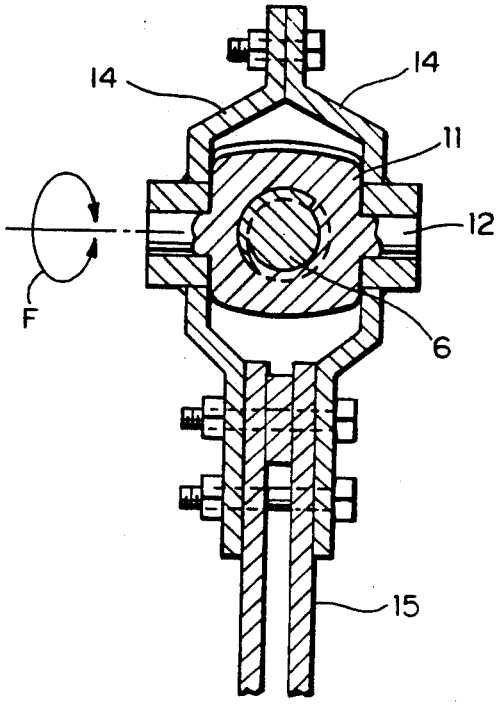
FIG. 3 is an enlarged cross-sectional view taken along line 3—3 of shown in FIG. 2 the mounting of the pivoting nut on the caster angle correcting tool head.

According to FIGS. 1, 2 and 3, the tool includes a clamp formed by parts 1 and 2 which may be fixed to the stub axle M by screws and nuts. The half 2 of the clamp has a lug 3 connecting with the joint bushing 4 mounted at the end 5 of the lever arm comprised by the worm screw shaft 6 and fixed in position by nut 7 engaging the threaded point 8 of the shaft 6. The opposite end 9 of shaft 6 is prepared to receive a driving means for rotation in the directions designated by arrow 10.

On the preferably square threaded shaft 6, a pivoting nut 11 is mounted provided at opposite sides with corresponding axle shafts 12 which may be coated with an antifriction material.

The nut axle shafts 12 are housed in bearings 13 provided in two symmetrical head parts 14 formed with angular portions and facing each other. These parts are fixed to a prismatic column 15 on which bosses 16 with threaded holes 17 are provided for fixing the required coupling disk by means of screws 25. Such disk may be of three types, wherein reference 18 (FIGS. 4, 5) designates the type for three screws T of the wheel drum R plate, reference 19 (FIG. 5) designates the type for four screws T, and reference 20 (FIG. 6) designates the type for five screws T of wheel drum plate R.

FIG. 2 is an elevational side view of the tool assembled and fixed by means of its clamp 1, 2 to the stub axle M of the suspension spring S on one side and to the corresponding wheel drum R plate (not shown) by means of the suitable disk 18, 19 or 20.

FIG. 3 is an enlarged cross-sectional view of each head 14 and nut 11 of the tool when assembled.

Arrow F (FIG. 3) shows the directions in which the nut 11 with its axle shafts 12 may rotate upon being operated, in order to maintain aligned the vector component of the force (compression or traction) imposed by the worm 6 by its driving means for rotation as designated schematically by arrow 10 (FIG. 2), this force acting with respect to the axis e of the stub axle M as the caster angle is being changed with reference to the plane P containing the corresponding wheel drum R surface.

FIG. 4 shows the disk 18 for supporting wheel drums R with three screws; to this end the disk is provided with three grooves 21 radially coming from the central hollow portion of the disk and may receive smaller diameter screws T, while grooves 22 inserted in the remaining spaces also extend radially towards the disk periphery, at a greater distance from the center, being suitable for supporting larger diameter drums R. Therefore, the length of each groove allows receiving screws within a broad range of radial distances. Holes 23 having larger diameter counter bores for screw heads 25 are used for fixing each disk on bosses 16 of column 15 of the tool.

FIG. 2 shows bosses 24 on the disks through which the holes for screws 25 pass for fixing at the threaded holes 17 of the other bosses 16.

FIG. 5 shows the disk 19 wherein two groove sets 26 and 27 are included, similar to those of the former disk.

FIG. 6 shows the groove distribution 28 and 29 arranged for receiving five screws T located at the plate R supporting this type of wheel.

In summary, the set of interchangeable disks 18, 19 and 20 is formed by a disk having a central opening from which a first plurality of grooves 21, 27 or 29 are projected at equal angles, which are distributed in steps with a second plurality of grooves, in an amount correspondingly equal to the first plurality of grooves, distributed towards the peripheral contour of the disk and designated with reference numerals 22, 26 or 28.

Operation of the tool is simple. The tool is fixed to the stub angle M of the suspension spring S by means of clamp 1, 2. Plate R, without its wheel, is attached to the corresponding disk 18, 19 or 20 according to the number of screws T supporting the wheel. The selected disks have already been mounted on column 15 by means of screws the heads of which are flush to the disk surface as shown in FIG. 2. When the caster angle is to be increased or decreased, the tool is operated by rotating the worm 6 in counterclockwise or clockwise direction 10 until the correct value is obtained. This value may be checked by means of a suitable gage.

This operation may be repeated twice or three times, at different opportunities, according to the mechanical strength of the material of which the stub axle M is made, until final replacement of the stub axle is required.

In the embodiment shown, column 15 of the lever is provided with bosses 16 at opposite faces whereby the tool may be prepared with two disks already mounted to afford the possibility of immediate use. If the third disk is required, its mounting will be simple by interchanging one of the disks which has been previously mounted.

I claim:

1. A tool for adjusting the caster angle of automobile wheels including an adjusting screw attached to a suspension spring stub axle of the automobile and coupled to a wheel drum plate, the tool comprising:

a prismatic head member;

a set of interchangeable wheel mounting disks;

means for removably mounting two of said disks of said set on said prismatic head;

an adjusting nut having a screw threaded bore therethrough;

a pair of co-axial axle shafts extending outwardly from opposite sides of said adjusting nut;

means for pivotally mounting said adjusting nut by said axle shafts on said prismatic head so that said adjusting nut is freely pivotable with respect to said prismatic head;

a screw threaded adjusting shaft extending through and operatively engaged in said adjusting nut screw threaded bore so that rotation of said adjusting shaft moves said shaft longitudinally in the direction of its central axis of rotation with respect to said adjusting nut and said prismatic head;

clamp means rotatably mounted on one end of said adjusting shaft for removably clamping onto said suspension spring stub axle; and means on the other end of said adjusting shaft to facilitate rotating said adjusting shaft, so that with said two disks mounted on said prismatic head and said wheel drum plate mounted on one of said disks, and said clamp means clamped onto said stub axle connected to said wheel drum plate, rotation of said adjusting shaft in either direction adjusts the caster angle of said automobile wheels.

2. The tool as claimed in claim 1 wherein:

said means for mounting said disks on said prismatic head comprises a pair of bosses extending from each side of said prismatic head;

a screw threaded bore in each of said bosses;

a pair of holes in each of said disks aligned with said screw threaded bores in said bosses in the assembled condition; and screws extending through said pair of holes in each disk and engageable in respective screw threaded bores.

3. The tool as claimed in claim 1 and further comprising:

a central opening in each of said interchangeable disks of said set of disks;

a plurality of first slots in each disk extending radially from said central opening in each disk and in equal angular relationship with respect to each other; and a plurality of second slots in each disk of said set of disks extending radially outwardly with respect to said central opening and equally angularly spaced with respect to each other and with respect to said first slots, each of said set having a different number of slots than the other disks of said set, so that said set of disks facilitates the use of said tool on different automobile wheels having different numbers of wheel attaching screws thereon.

4. The tool as claimed in claim 2 and further comprising:

a central opening in each of said interchangeable disks of said set of disks;

a plurality of first slots in each disk extending radially from said central opening in each disk and in equal angular relationship with respect to each other; and a plurality of second slots in each disk of said set of disks extending radially outwardly with respect to said central opening and equally angularly spaced with respect to each other and with respect to said first slots, each of said disks of said set having a different number of slots than the other disks of said set, so that said set of disks facilitates the use of said tool on different automobile wheels having different numbers of wheel attaching screws thereon.

5. The tool as claimed in claim 3 wherein:

said number of each of said first and second slots for any one of said disks of said set of disks is selected from the group consisting of 3, 4 and 5.

* * * * *